US009168985B2

(12) United States Patent
Liu et al.

(10) Patent No.: US 9,168,985 B2
(45) Date of Patent: Oct. 27, 2015

(54) FRAME SHAPED SUBMERSIBLE DECK BOX STRUCTURE COMPRISING AT LEAST ONE STRUCTURAL MODULE

(71) Applicant: Bassoe Technology AB, Göteborg (SE)

(72) Inventors: Yungang Liu, Partille (SE); Gerry Steen, Göteborg (SE)

(73) Assignee: Bassoe Technology AB, Göteborg (SE)

( * ) Notice: Subject to any disclaimer, the term of this patent is extended or adjusted under 35 U.S.C. 154(b) by 0 days.

(21) Appl. No.: 14/385,022

(22) PCT Filed: Feb. 12, 2013

(86) PCT No.: PCT/SE2013/050116

§ 371 (c)(1),
(2) Date: Sep. 12, 2014

(87) PCT Pub. No.: WO2013/137798

PCT Pub. Date: Sep. 19, 2013

(65) Prior Publication Data

US 2015/0027358 A1 Jan. 29, 2015

(30) Foreign Application Priority Data

Mar. 15, 2012 (SE) ..... 1250244

(51) Int. Cl.
*B63B 35/44* (2006.01)
*F24F 13/00* (2006.01)

(52) U.S. Cl.
CPC ..... *B63B 35/44* (2013.01); *F24F 13/00* (2013.01)

(58) Field of Classification Search
USPC ..... 114/264–266
IPC ..... B63B 35/44,35/4413
See application file for complete search history.

(56) References Cited

U.S. PATENT DOCUMENTS 3,434,293 A 3/1969 Brown
4,585,373 A * 4/1986 Collipp ..... 405/224

(Continued)

FOREIGN PATENT DOCUMENTS

GB 868917 A 5/1961
GB 2259536 A 3/1993

(Continued)

OTHER PUBLICATIONS

International Preliminary Report on Patentability received for PCT Patent Application No. PCT/SE2013/050116, mailed on Jul. 2, 2014, 7 pages.
International Search Report and Written Opinion received for PCT Patent Application No. PCT/SE2013/050116, mailed on Jul. 2, 2013, 13 pages.

*Primary Examiner* — Stephen Avila
(74) *Attorney, Agent, or Firm* — Morrison & Foerster LLP

(57) ABSTRACT

A semi-submersible offshore platform comprises a main structure comprising two longitudinal lower side beam structures, two transverse lower side beam structures and four columns, the longitudinal and transverse lower side beam structures are located between the four columns connecting the four columns with each other such that the semi-submersible offshore platform exhibits a frame shaped submersible pontoon having a lower central opening the four columns extends upwards from the frame shaped submersible pontoon. The main structure of the semi-submersible offshore platform comprises two longitudinal upper side beam structures and two transverse upper side beam structures, the longitudinal and transverse upper side beam structures are located between the four columns connecting the four columns with each other such that the semi-submersible offshore platform exhibits a frame shaped deck box structure having an upper central opening for receiving at least one structural module.

13 Claims, 7 Drawing Sheets

(56) References Cited

U.S. PATENT DOCUMENTS

| | | | | |
|---|---|---|---|---|
| 4,984,935 | A * | 1/1991 | de Oliveira Filho et al. | 405/224 |
| 6,899,492 | B1 * | 5/2005 | Srinivasan | 405/205 |
| 7,891,909 | B2 * | 2/2011 | Tahar et al. | 405/195.1 |
| 7,963,241 | B2 * | 6/2011 | Srinivasan | 114/267 |
| 2004/0159274 | A1 * | 8/2004 | Ankarsward | 114/264 |
| 2005/0058513 | A1 * | 3/2005 | Martensson et al. | 405/203 |
| 2005/0120935 | A1 * | 6/2005 | Wybro et al. | 114/265 |
| 2005/0217554 | A1 * | 10/2005 | Steen | 114/265 |

FOREIGN PATENT DOCUMENTS

| | | | |
|---|---|---|---|
| NO | 963323 | L | 2/1998 |
| SE | 468350 | B | 12/1992 |
| WO | 96/23690 | A1 | 8/1996 |

* cited by examiner

FRAME SHAPED SUBMERSIBLE DECK BOX STRUCTURE COMPRISING AT LEAST ONE STRUCTURAL MODULE

CROSS REFERENCE TO RELATED APPLICATIONS

This application is a U.S. National Phase patent application of PCT/SE2013/050116, filed on Feb. 12, 2013, which claims priority to Swedish Patent Application No. 1250244-9, filed on Mar. 15, 2012, the entire contents of which are incorporated herein by reference.

FIELD OF THE INVENTION

The present invention relates to the field of floating offshore vessels, and more particularly, to semi-submersible offshore platforms/vessels having a lower hull with a frame shaped submersible pontoon, and where the offshore platform is designed to receive one or several modules.

BACKGROUND OF THE INVENTION

Today, there exist various examples of semi-submersible offshore platforms, for receiving modules, such as modules comprising of for example process equipment, electrical equipment or utility equipment.

Semi-submersible offshore platforms do not rest on the seabed. Instead, the working deck sits atop large pontoons and hollow columns, these float high in the water when the semi-submersible offshore platform is moved. At a field location, personnel pumps seawater into the pontoons and columns to partially submerge the semi-submersible offshore platform, hence the name semi-submersible. With much of its bulk below the water's surface, the semi-submersible offshore platform becomes a stable platform for drilling and production, moving only slightly with wind, wave and currents. Semi-submersible offshore platforms are used for various services such as production of hydrocarbons, drilling and/or to provide living accommodation for personnel.

In conventional semi-submersible offshore platforms, a load-supporting, rectangular deck box structure is positioned upon the top of the columns. Modules are then placed on top of the deck box structure. The deck box structure offers a structurally solid design and may be of a sealed type, which adds reserve buoyancy to the semi-submersible offshore platform in an eventual damaged emergency state.

A disadvantage with these known conventional design is that the modules have to be placed relatively high on the semi-submersible offshore platform which leads to a high centre of gravity for the modules, and accordingly for the completed offshore platform. This results in a reduction in stability for the semi-submersible offshore platform and as a consequence a lesser pay-load, or alternatively the size of the semi-submersible offshore platform has to be increased to compensate for the high vertical centre of gravity of the modules. These conventional designs are restricted to provide relatively heavy and bulky semi-submersible offshore platforms. Further, these types of semi-submersible offshore platforms have a limited ventilation capacity of the deck box and may also have difficulties to utilize the deck box space in an effective way.

It is preferred to provide semi-submersible offshore platforms which can lower the centre of gravity for the modules and the semi-submersible offshore platforms. US2005217554 discloses a semi-submersible offshore vessel having an upper deck structure which is generally C-shaped which enables a lower centre of gravity for the modules and the semi-submersible offshore vessel. However, this solution leads to a relatively heavy, bulky and complex semi-submersible offshore vessel. This known example provide limited reserve buoyancy to the semi-submersible offshore platform. Further, this solution is restricted to a time consuming assembly, installation, maintenance, and provide limited construction flexibility. Further, this type of semi-submersible offshore platform has a limited ventilation capacity of the platform.

There is thus a need for an improved semi-submersible offshore platform removing the above mentioned disadvantages.

SUMMARY OF THE INVENTION

The present invention relates to the field of floating offshore platforms. More specifically, the present invention relates to a solution for a semi-submersible offshore platform, wherein the semi-submersible offshore platform has a deck structure which is adapted to receive at least one module in such a way that both a relatively low point of gravity for the entire offshore platform and a relatively high reserve buoyancy to the semi-submersible offshore platform are enabled. The semi-submersible offshore platform may for example be of catenary moored type, taut leg moored and/or tendon moored type (Tension Leg Platform). It is desirable to provide a relatively light-weight, non-bulky and compact semi-submersible offshore platform for modules, wherein the semi-submersible offshore provided with one or several modules have a relatively low point of gravity.

The object of the present invention is to suggest an improved semi-submersible offshore platform which provide a relatively low centre of gravity and relatively high reserve buoyancy and which also reduces the total weight of the semi-submersible offshore platform together with at least one module.

The present invention is defined by the appended independent claims. Various examples of the invention are set forth by the appended dependent claims as well as by the following description and the accompanying drawings.

With the above description in mind, then, an aspect of the present invention is to provide an improved semi-submersible offshore platform which seeks to mitigate, alleviate, or eliminate one or more of the above-identified deficiencies in the art and disadvantages singly or in any combination.

The object is achieved by the features of claim 1 wherein, a semi-submersible offshore platform comprises a main structure comprising two longitudinal lower side beam structures, two transverse lower side beam structures and four columns, the longitudinal and transverse lower side beam structures are located between the four columns connecting the four columns with each other such that the semi-submersible offshore platform exhibits a frame shaped submersible pontoon having a lower central opening the four columns extends upwards from the frame shaped submersible pontoon, characterized in that the main structure of the semi-submersible offshore platform comprises two longitudinal upper side beam structures and two transverse upper side beam structures, the longitudinal and transverse upper side beam structures are located between the four columns connecting the four columns with each other such that the semi-submersible offshore platform exhibits a frame shaped deck box structure having an upper central opening for receiving at least one structural module. Thereby, semi-submersible offshore platform constitutes a relatively light-weight construction. Since the semi-submersible offshore platform comprise an upper central opening a relatively flexible construction is enabled which can reduce the installation and maintenance of the semi-submersible offshore platform and different installation of the semi-submersible offshore platform. Further, the upper central opening and the design of the semi-submersible offshore platform enables a relatively non-bulky and semi-submersible offshore platform having reduced weight. The upper central opening also reduces the risk for dangerous gases from building up underneath the platform. Since structural modules can be placed in the central opening of the frame shaped deck box structure a relatively low point of gravity for the offshore platform can be achieved. Structural modules can be fastened to the frame shaped deck box structure by for example welding or bolting.

According to a further advantageous aspect of the invention, the longitudinal and transverse upper side beam structures and the four columns exhibiting the frame shaped deck box structure are load carrying structural elements arranged to be able to carry at least one structural module. Thus, the frame shaped deck box structure is used to place structural modules within the upper central opening.

According to a further advantageous aspect of the invention, the frame shaped deck box structure and the upper central opening have a substantially rectangular shape. The upper central opening has a shape which can correspond to one or several structural modules such that one or several structural modules can hang within the upper central opening. This provides a bottom ventilation of the structural modules since the structural modules hang in the upper central opening. Further, this construction allows air to flow through the upper central opening enabling an improved ventilation of the entire semi-submersible offshore platform. Thus, the ventilation capacity of both the at least one structural module and the semi-submersible offshore platform are increased and the risk of dangerous gases building up a high pressure within the semi-submersible offshore platform is decreased.

According to a further advantageous aspect of the invention, the longitudinal and transverse upper side beam structures comprise side beam upper surfaces, the four columns comprise upper portions comprising column upper surfaces which are located between the side beam upper surfaces, wherein the side beam upper surfaces and the column upper surfaces define a horizontal load hanging plane. The structural module can be adapted to hang from the upper side beam structures. Structural modules can be fastened to the upper side beam structures by for example welding or bolting.

According to a further advantageous aspect of the invention, the upper central opening comprises a reinforcing deck box beam arranged to connect the longitudinal upper side beam structures or the transverse upper side beam structures, the reinforcing deck box beam is located in the same load hanging plane as the longitudinal and transverse upper side beam structures, the reinforcing deck box beam is a load carrying structural element arranged to be able to carry the at least one structural module. The structural module can be adapted to hang from the reinforcing deck box beam. Structural modules can be fastened to the reinforcing deck box beam by for example welding or bolting. The reinforcing deck box beam increases the stability of the semi-submersible offshore platform.

According to a further advantageous aspect of the invention, the upper central opening comprises at least one lower beam arranged to connect the reinforcing deck box beam with the longitudinal upper side beam structures or the transverse upper side beam structures, the at least one lower beam comprises a lower beam upper surface which define a lower first supporting plane which is parallel to the load hanging plane, the at least one lower beam is a load supporting structural element arranged to be able to support the at least one structural module. The structural module can be adapted to be positioned on the at least one lower beam. Structural modules can be fastened to the at least one lower beam by for example welding or bolting. The at least one lower beam increases the stability of the semi-submersible offshore platform.

According to a further advantageous aspect of the invention, the upper central opening comprises a grid of lower beams arranged to connect the longitudinal upper side beam structures and the transverse upper side beam structures, the lower beams of the grid comprises lower beam upper surfaces which define a lower first supporting plane which is parallel to the load hanging plane, the grid of lower beams is a load supporting structure arranged to be able to support the at least one structural module. The structural module can be adapted to be positioned on the grid of lower beams. Structural modules can be fastened to the grid of lower beams by for example welding or bolting. The grid of lower beams increases the stability of the semi-submersible offshore platform.

According to a further advantageous aspect of the invention, the deck box structure comprises at least one ledge beam protruding from the longitudinal and transverse upper side beam structures into the upper central opening, the at least one ledge beam comprises a ledge upper surface which define a lower second supporting plane which is parallel to the load hanging plane, the at least one ledge beam is arranged to act as a supporting console for the at least one structural module. The structural module can be adapted to be positioned on the at least one ledge beam. Structural modules can be fastened to the at least one ledge beam by for example welding or bolting.

According to a further advantageous aspect of the invention, the longitudinal and transverse upper side beam structures comprise wall sections perforated with a plurality of side beam openings, which enables a more light-weight construction and natural ventilation.

According to a further advantageous aspect of the invention, the longitudinal and transverse upper side beam structures comprise sealed areas, which provide both extra reserve buoyancy for the offshore platform and additional area for equipment of the offshore platform.

The object is further achieved by a structural module characterised in that the structural module has a substantially rectangular shape, the structural module comprises at least a first and second load carrying protruding element, the first load carrying protruding element is located on a first module side and the second load carrying protruding element is located on a second module side, the at least two load carrying protruding elements are arranged at a distance from a bottom of the structural module such that the structural module can hang, being carried by the at least two load carrying protruding elements. The load carrying protruding elements can be fastened to the semi-submersible offshore platform by for example welding or bolting.

The object is further achieved by a semi-submersible offshore platform according to the invention comprising at least one structural module according to the invention, characterised in that the at least one structural module is connected to the semi-submersible offshore platform such that the at least one structural module hangs in the upper central opening of the semi-submersible offshore platform. The at least one structural module can be fastened to the semi-submersible offshore platform by for example welding or bolting.

According to a further advantageous aspect of the invention, the at least two protruding elements are positioned on the frame shaped deck box structure and/or the reinforcing deck box beam such that the structural module hangs in the upper central opening, where the frame shaped deck box structure and/or the reinforcing deck box beam and the at least two protruding elements are the load carrying structure for the at least one structural module hanging in the upper central opening.

According to a further advantageous aspect of the invention, the at least one structural module is arranged to be supported by the at least one lower beam and/or the at least one ledge beam.

According to a further advantageous aspect of the invention several structural modules hangs in the upper central opening of the semi-submersible offshore platform.

Any of the advantageous features of the present invention above may be combined in any suitable way.

A number of advantages are provided by means of the present invention, for example:

- providing a solution with a light-weight construction for the semi-submersible offshore platform together with at least one structural module is obtained;
- an improved semi-submersible offshore platform is obtained allowing for non-bulky, compact and flexible construction;
- providing an semi-submersible offshore platform with at least one module allowing for a relatively low point of gravity for the entire construction is obtained;
- an improved semi-submersible offshore platform is obtained allowing for improved ventilation of the at least one structural module and the offshore platform;
- simplified installation and maintenance is allowed.

BRIEF DESCRIPTION OF THE DRAWINGS

The present invention will now be described in detail with reference to the figures, wherein.

It should be added that the following description of the examples is for illustration purposes only and should not be interpreted as limiting the invention exclusively to these examples/aspects.

DETAILED DESCRIPTION OF THE INVENTION

All the FIGS. 1 to 6 are schematically illustrated.

The following examples of the present invention relate, in general, to the field of floating offshore platforms in particularly, to semi-submersible offshore platforms.

Examples of the present invention will be described more fully hereinafter with reference to the accompanying drawings, in which examples of the invention are shown. This invention may, however, be embodied in many different forms and should not be construed as limited to the examples set forth herein. Rather, these examples are provided so that this disclosure will be thorough and complete, and will fully convey the scope of the invention to those skilled in the art. Like reference signs refer to like elements throughout.

Figure 1A:
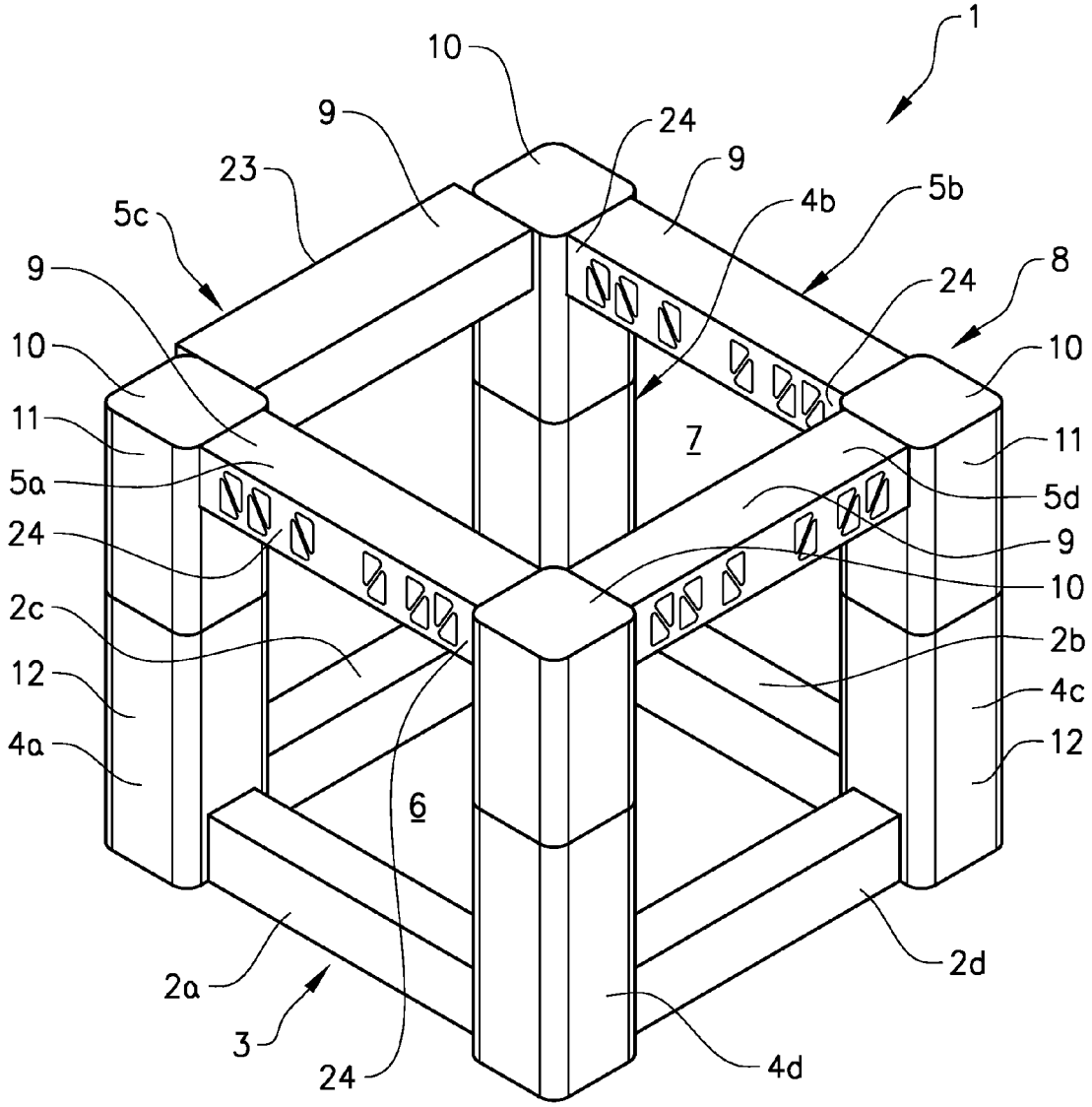
FIG. 1*a* schematically shows a perspective view illustration of a semi-submersible offshore platform according to the invention.
Figure 1B:
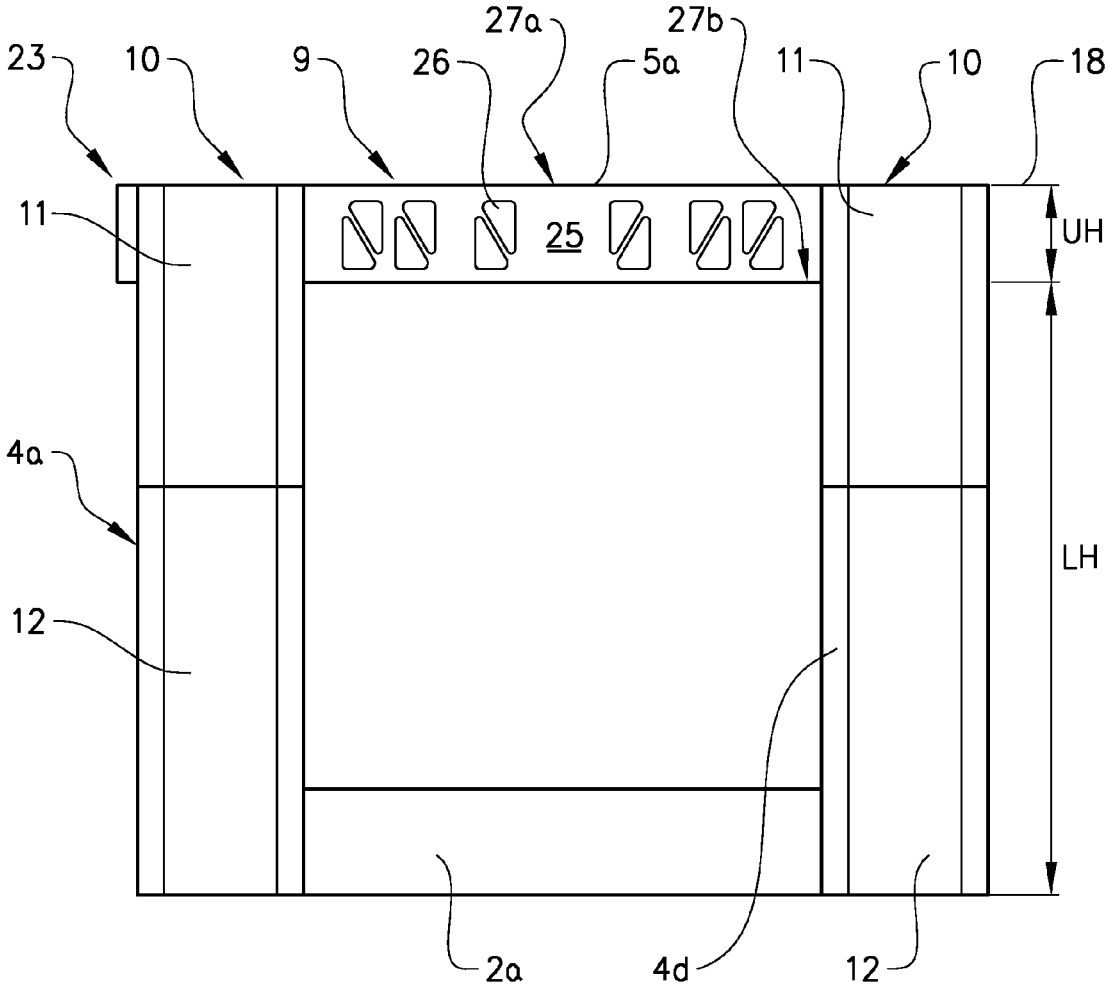
FIG. 1*b* schematically shows a side view illustration of a semi-submersible offshore platform according to the invention.

FIG. 1*a* show a perspective view of a simplified example of a semi-submersible offshore platform 1 according to the invention and FIG. 1*b* schematically shows a side view illustration of a semi-submersible offshore platform 1 according to the invention. The semi-submersible offshore platform 1 comprises a first supporting column 4*a*, a second supporting column 4*b*, a third supporting column 4*c*, a fourth supporting column 4*d*, a first longitudinal lower side beam structure 2*a*, a second longitudinal lower side beam structure 2*b*, a first transverse lower side beam structure 2*c*, a second transverse lower side beam structure 2*d*, a first longitudinal upper side beam structure 5*a*, a second longitudinal upper side beam structure 5*b*, a first transverse upper side beam structure 5*c* and a second transverse upper side beam structure 5*d*. The longitudinal and transverse lower side beam structures 2*a*, 2*b*, 2*c*, 2*d* are located between the four columns 4*a*, 4*b*, 4*c*, 4*d* connecting the four columns 4*a*, 4*b*, 4*c*, 4*d* with each other such that the semi-submersible offshore platform 1 exhibits a frame shaped submersible pontoon 3 having a lower central opening 6. The four columns 4*a*, 4*b*, 4*c*, 4*d* extend upwards from the frame shaped submersible pontoon 3.

The longitudinal and transverse upper side beam structures 5*a*, 5*b*, 5*c*, 5*d* are located between the four columns 4*a*, 4*b*, 4*c*, 4*d* connecting the four columns 4*a*, 4*b*, 4*c*, 4*d* with each other such that the semi-submersible offshore platform 1 exhibits a frame shaped deck box structure 8 having an upper central opening 7 for receiving at least one structural module. Each column 4*a*, 4*b*, 4*c*, 4*d* is connected to and located between one longitudinal upper side beam 5*a*, 5*b* and one transverse upper side beam 5*c*, 5*d*.

Normally, the frame shaped pontoon 3 is substantially rectangular. The frame shaped pontoon 3 may be of any appropriate shape such as for example circular or polyhedral. The frame shaped pontoon 3 is a closed pontoon structure and comprises a lower central opening 6 in the pontoon 3. Normally, the frame shaped deck box structure 8 and the upper central opening 7 are substantially rectangular.

The longitudinal and transverse lower side beam structures 2*a*, 2*b*, 2*c*, 2*d* and lower portions 12 of the four columns 4*a*, 4*b*, 4*c*, 4*d* constitutes a lower hull (LH) and the longitudinal and transverse upper side beam structures 5*a*, 5*b*, 5*c*, 5*d* and upper portions 11 of the four columns 4*a*, 4*b*, 4*c*, 4*d* constitutes the upper hull (UH) of the semi-submersible offshore platform 1. The upper portions 11 of the four columns 4*a*, 4*b*, 4*c*, 4*d* are connected and located between the longitudinal and transverse upper side beams 5*a*, 5*b*, 5*c*, 5*d* exhibiting the frame shaped deck box structure 8.

The longitudinal and transverse upper side beams 5*a*, 5*b*, 5*c*, 5*d* comprise side beam upper surfaces 9. The four columns 4*a*, 4*b*, 4*c*, 4*d* comprise the upper portions 11 where the upper portion 11 have column upper surfaces 10 which are located between the side beam upper surfaces 9. The side beam upper surfaces 9 and the column upper surfaces 10 define a horizontal load hanging plane in which the structural module can be hanged.

The four columns 4*a*, 4*b*, 4*c*, 4*d* extend vertically upwards from the frame shaped pontoon 3. The first, second, third and fourth column 4*a*, 4*b*, 4*c*, 4*d* have a substantially rounded rectangular cross section. However, the shape of the cross section of the columns 4*a*, 4*b*, 4*c*, 4*d* may be of any appropriate shape such as for example square, circular or triangular. The size of the cross section may vary in size from a lower bottom part of the lower portions 12 of the columns 4*a*, 4*b*, 4*c*, 4*d* to an upper top part of the upper portions 11 of the columns 4*a*, 4*b*, 4*c*, 4*d*.

As can be seen from FIG. 1*a*, the frame shaped deck box structure 8 comprises of two longitudinal upper side beam structures 5*a*, 5*b* and two transverse upper side beam structures 5*c*, 5*d* located between the four columns 4*a*, 4*b*, 4*c*, 4*d*. The two longitudinal upper side beam structures 5*a*, 5*b* and two transverse upper side beam structures 5*c*, 5*d* comprises a main deck 27*a* and a lower deck 27*b*. The longitudinal upper side beam structures 5*a*, 5*b* and transverse upper side beam structures 5*c*, 5*d* of the upper hull (UH) may comprise of one or several decks.

Different types of installations and equipments may be placed on the main deck 27*a* of the semi-submersible offshore platform 1. Different types of installations and equipments may be placed in the lower deck 27*b* of the semi-submersible offshore platform 1.

The longitudinal and transverse upper side beam structures 5*a*, 5*b*, 5*c*, 5*d* comprise wall sections 25 which may comprise a plurality of side beam openings 26 and thereby improving the ventilation and reducing the weight of the semi-submersible offshore platform 1.

In the example of FIGS. 1*a* and 1*b*, the entire first transverse upper side beam structure 5*c* is sealed creating a sealed area 23 wherein different types of installations and equipments may be placed in the lower deck 27*b* within this sealed area 23. This sealed area 23 provides an extra bouncy reserve.

Section areas of the longitudinal and transverse upper side beam structures 5*a*, 5*b*, 5*c*, 5*d* adjacent the four columns 4*a*, 4*b*, 4*c*, 4*d* can be sealed creating sealed section areas 24 such that different types of installations and equipments may be placed in the lower deck 27*b* within these sealed section areas 24. These sealed section areas 24 provide an extra bouncy reserve.

Figure 2:
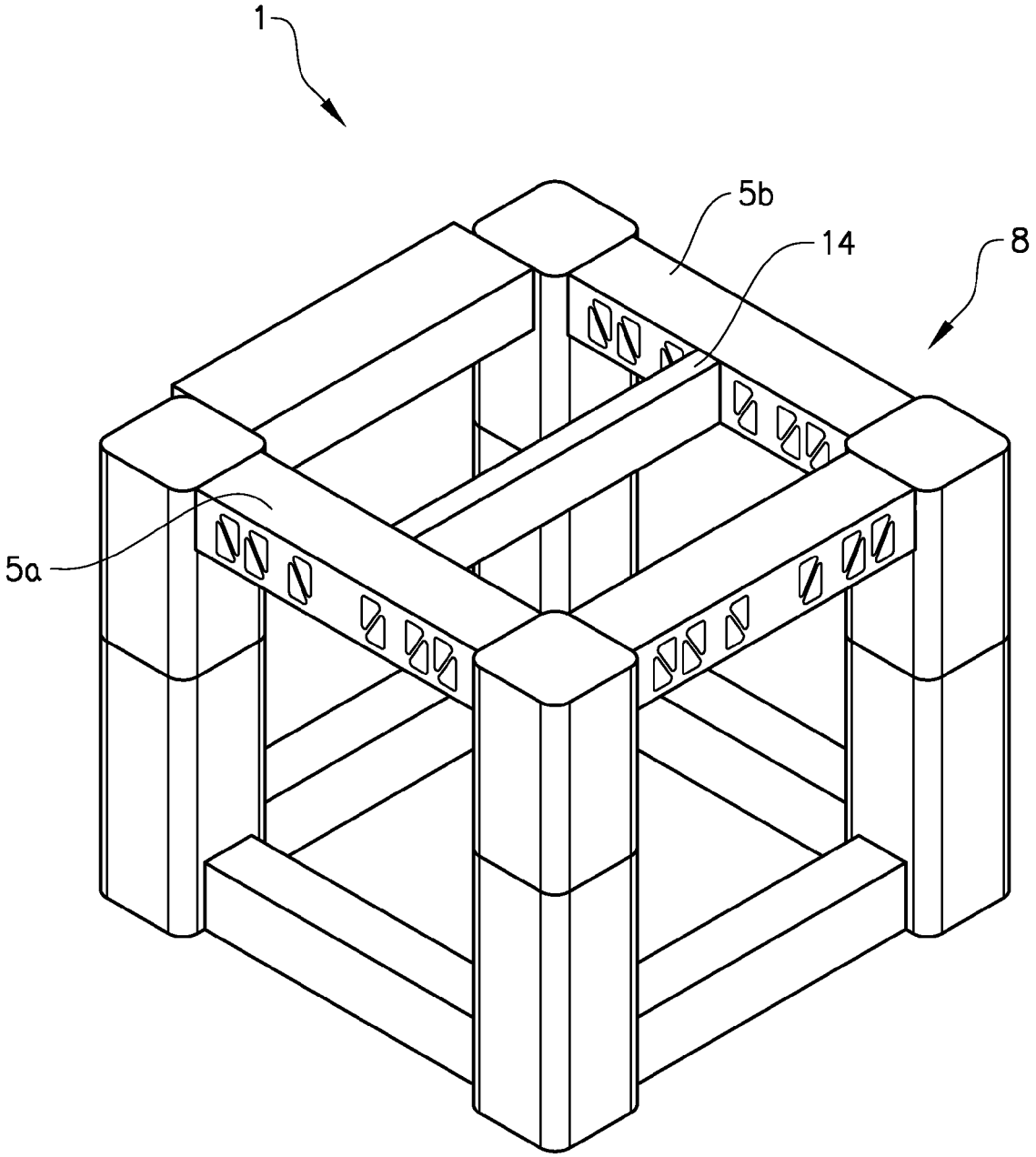
FIG. 2 schematically shows a perspective view illustration of a semi-submersible offshore platform according to the invention.

FIG. 2 schematically shows a perspective view illustration of a semi-submersible offshore platform 1 according to the invention, wherein a reinforcing deck box beam 14 is arranged to connect the longitudinal upper side beam structures 5*a*, 5*b*. The reinforcing deck box beam 14 can for example be welded or bolted to the upper beam structure or by any appropriate fastening. The reinforcing deck box beam 14 is located in the same load hanging plane as the longitudinal and transverse upper side beam structures 5*a*, 5*b*, 5*c*, 5*d*. The reinforcing deck box beam 14 is a load carrying structural element arranged to be able to carry the at least one structural module. The reinforcing deck box beam 14 increases the stability of the semi-submersible offshore platform 1.

Figure 3:
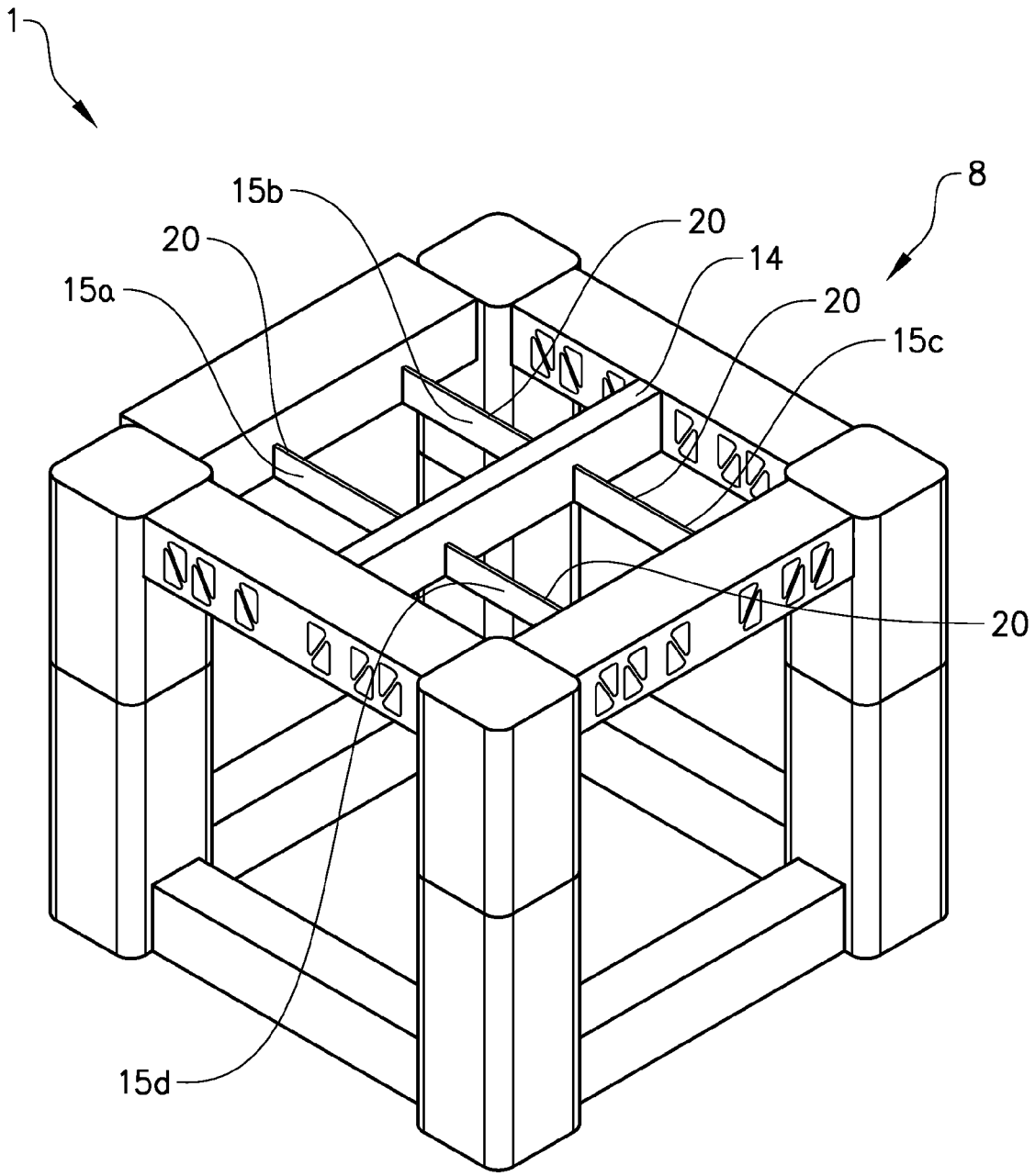
FIG. 3 schematically shows a perspective view illustration of a semi-submersible offshore platform according to the invention.

FIG. 3 schematically shows a perspective view illustration of a semi-submersible offshore platform according to the invention, wherein a first lower beam 15*a*, a second lower beam 15*b*, a third lower beam 15*c*, and a fourth lower beam 15*d* are arranged between the reinforcing deck box beam 14 which is arranged to connect the longitudinal upper side beam structures 5*a*, 5*b*. The four lower beams 15*a*, 15*b*, 15*c*, 15*d* connect the reinforcing deck box beam 14 with the transverse upper side beam structures. The four lower beams 15*a*, 15*b*, 15*c*, 15*d* are fastened to the reinforcing deck box beam 14 and to the transverse upper side beam structures by conventional fastening methods such as welding or bolting. The upper central opening comprises the four lower beams 15*a*, 15*b*, 15*c*, 15*d* and each of the four lower beams 15*a*, 15*b*, 15*c*, 15*d* comprises a lower beam upper surface 20 which define a lower first supporting plane which is parallel to the load hanging plane. The four lower beams 15*a*, 15*b*, 15*c*, 15*d* are load supporting structural elements arranged to be able to support one or several structural modules in such a way that the structural modules are positioned above the four lower beams 15*a*, 15*b*, 15*c*, 15*d* wherein the structural modules rest on the four lower beams 15*a*, 15*b*, 15*c*, 15*d*. The distance between the upper load hanging plane and the lower first supporting plane may vary depending on structure strength and topside layout arrangement.

Figure 4:
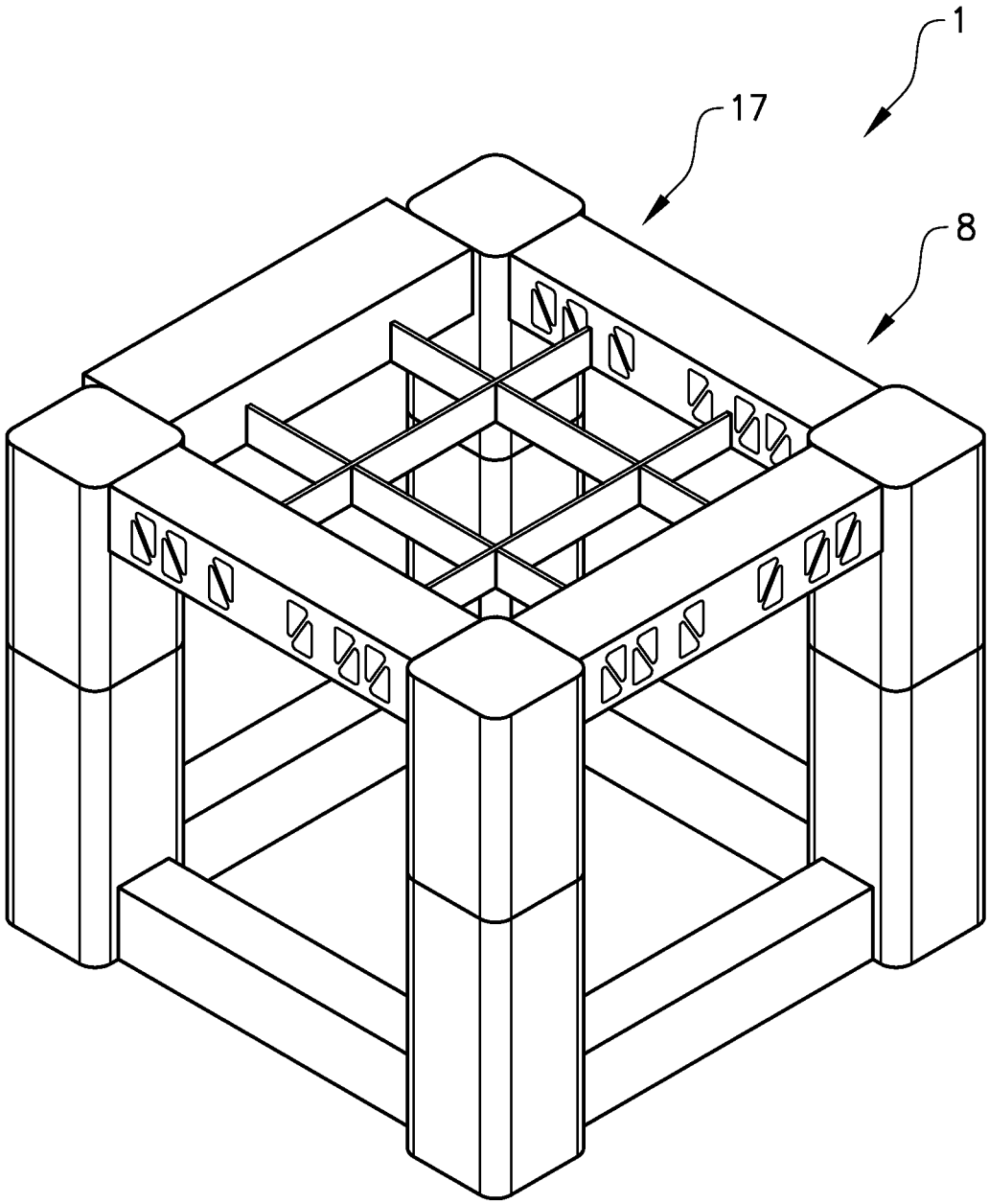
FIG. 4 schematically shows a perspective view illustration of a semi-submersible offshore platform according to the invention.

FIG. 4 schematically shows a perspective view illustration of a semi-submersible offshore platform according to the invention, wherein a grid 17 of lower beams are arranged in the upper central opening of the frame shaped deck box structure 8 between the upper longitudinal side beam structures and the upper transverse side beam structures. The grid 17 of lower beams is a load supporting structural element arranged to be able to support one or several structural modules in such a way that the structural modules are positioned above the grid 17 of lower beams wherein the structural modules rest on the lower beams.

Figure 5A:
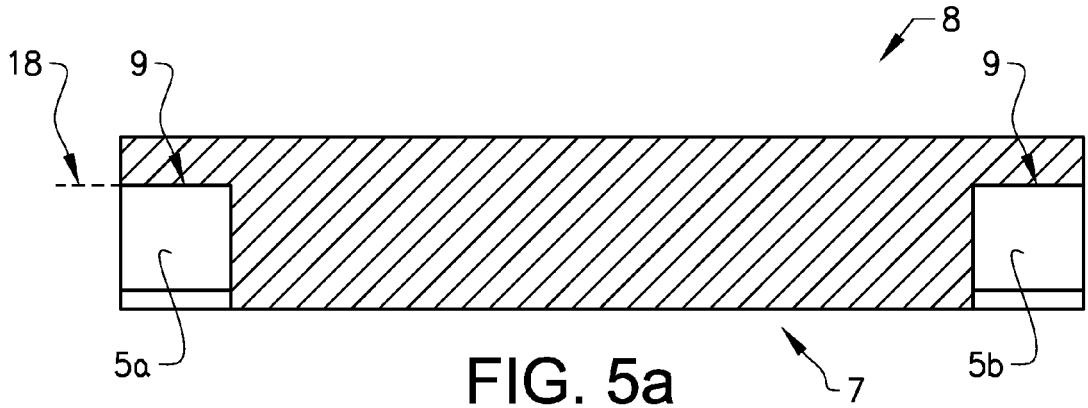
FIG. 5*a*, 5*b*, 5*c*, 5*d* schematically shows side view illustrations of cross sections of deck box structures according to the invention.

FIG. 5*a* schematically shows side view illustration of a cross section of a deck box structure 8 of a semi-submersible offshore platform according to the invention. As can be seen from the example of a semi-submersible offshore platform in FIG. 5*a*, the first and second upper longitudinal side beam structures 5*a*, 5*b* delimit the upper central opening 7 in a transverse direction wherein structural modules can hang. The first and second upper transverse side beam structures delimit the upper central opening 7 in a longitudinal direction. The side beam upper surfaces 9 of the upper first and second longitudinal side beam structures 5*a*, 5*b* define the load hanging plane 18. Structural modules can be connected and fastened to the side beam upper surfaces 9 in the load hanging plane 18, wherein they can hang in the upper central opening.

Figure 5B:
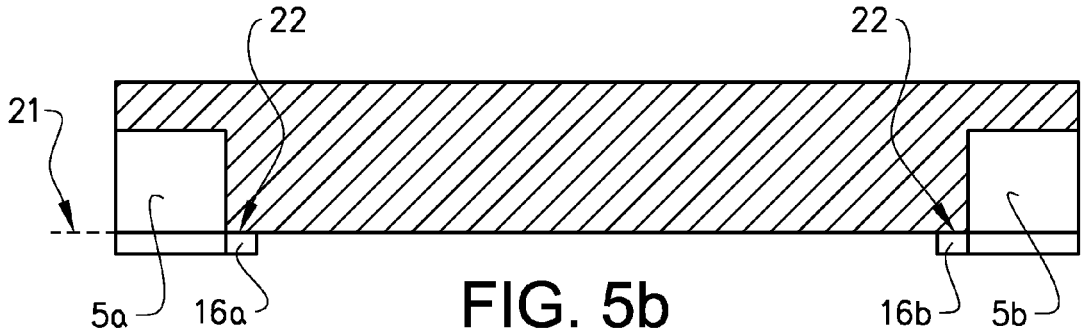

FIG. 5*b* schematically shows side view illustration of a cross section of a deck box structure of a semi-submersible offshore platform according to the invention. As can be seen from the example of the semi-submersible offshore platform in FIG. 5*b*, a first and a second ledge beam 16*a*, 16*b* protrude from the first and second upper longitudinal side beam structures 5*a*, 5*b*. The ledge beams 16*a*, 16*b* comprises ledge upper surfaces 22 which define a lower second supporting plane 21 which is parallel to the load hanging plane. The ledge beams 16*a*, 16*b* are arranged to act as supporting consoles for one or several modules.

Figure 5C:
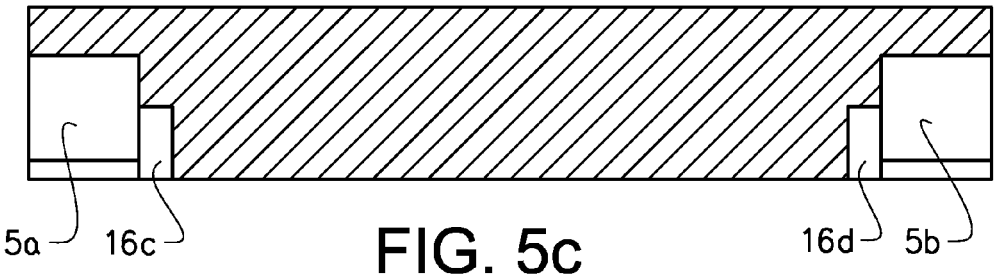

FIG. 5*c* schematically shows side view illustration of a cross section of a deck box structure of a semi-submersible offshore platform according to the invention. As can be seen from the example of the semi-submersible offshore platform in FIG. 5*c*, a third and a fourth ledge beam 16*c*, 16*d* protrude from the first and second upper longitudinal side beam structures 5*a*, 5*b*. The vertical distance between the load hanging plane and the second supporting plane may be varied.

Figure 5D:
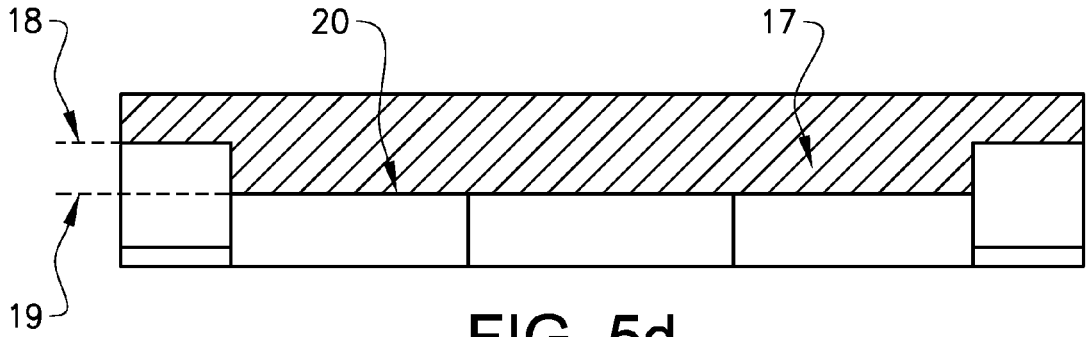

FIG. 5*d* schematically shows side view illustration of a cross section of a deck box structure of a semi-submersible offshore platform according to the invention. As can be seen from the example of a semi-submersible offshore platform in FIG. 5*d*, the upper central opening comprises a grid 17 of lower beams which comprise lower beam upper surfaces 20 which define a lower first supporting plane 19 which is parallel to the load hanging plane 18.

Figure 6:
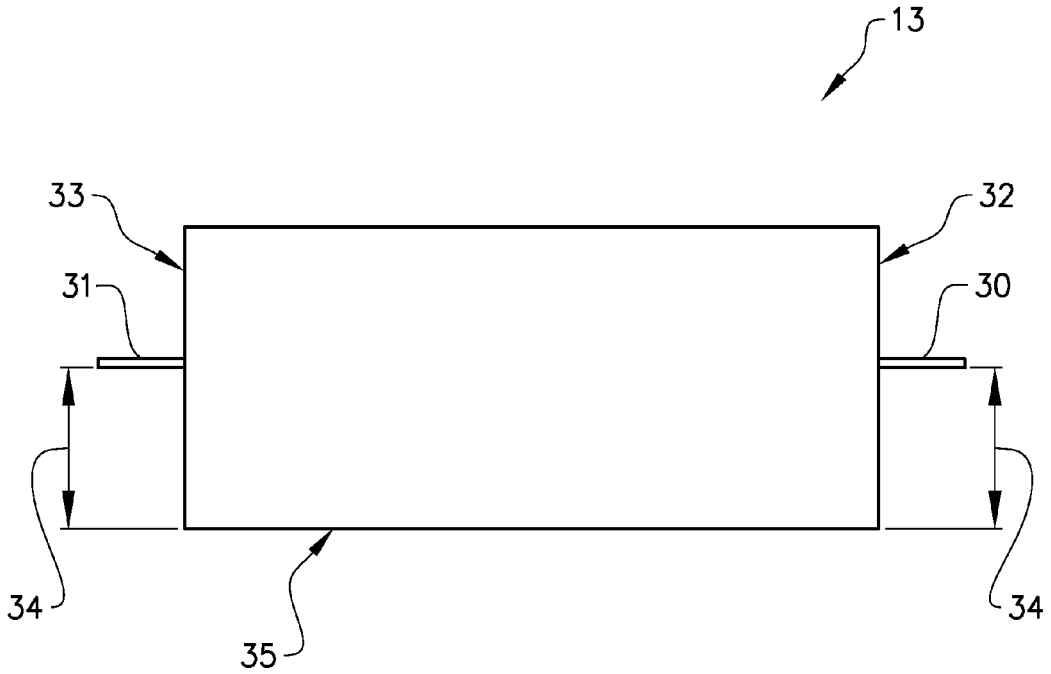
FIG. 6 schematically shows side view illustration of a structural module according to the invention.

FIG. 6 schematically shows side view illustration of a structural module 13 according to the invention. The structural module 13 has a substantially rectangular shape. The structural module 13 comprises at least a first and second load carrying protruding element 30, 31. The first load carrying protruding element 30 is located on a first module side 32 and the second load carrying protruding element 31 is located on a second module side 33. The at least two load carrying protruding elements 30, 31 are arranged at a distance 34 from a bottom 35 of the structural module 13 such that the structural module 13 can hang, being carried by the at least two load carrying protruding elements 30, 31. The structural module 13 and the load carrying protruding elements 30, 31 are adapted to be hanged within the central opening of the semi-submersible offshore platform according to the invention. The protruding elements 30, 31 of the structural module 13 can be placed on the frame shaped deck box structure in the load hanging plane. The protruding elements 30, 31 can be fastened to the semi-submersible offshore platform in any appropriate way such as by welding or bolting.

The invention is not limited to the example described above, but may be modified without departing from the scope of the claims below.

The terminology used herein is for the purpose of describing particular examples only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

The foregoing has described the principles, preferred examples and modes of operation of the present invention. However, the invention should be regarded as illustrative rather than restrictive, and not as being limited to the particular examples discussed above. The different features of the various examples of the invention can be combined in other combinations than those explicitly described. It should therefore be appreciated that variations may be made in those examples by those skilled in the art without departing from the scope of the present invention as defined by the following claims.

REFERENCE SIGNS

1: Offshore platform
2*a*: First longitudinal lower side beam structure
2*b*: Second longitudinal lower side beam structure
2*c*: First transverse lower side beam structure
2*d*: Transverse lower side beam structure
3: Frame shaped submersible pontoon
4*a*: First column
4*b*: Second column
4*c*: Third column
4*d*: Fourth column
5*a*: First longitudinal upper side beam structure
5*b*: Second longitudinal upper side beam structure
5*c*: First transverse upper side beam structure
5*d*: Second transverse upper side beam structure
6: Lower central opening in pontoon
7: Upper central opening in deck structure
8: Frame shaped deck box structure
9: Side beam upper surface
10: Column upper surface
11: Upper portions of columns
12: Lower portions of columns
13: Module
14: Reinforcing beam
15*a*: First lower beam
15*b*: Second lower beam
15*c*: Third lower beam
15*d*: Fourth lower beam
16*a*: First ledge beam
16*b*: Second ledge beam
16*c*: Third ledge beam
16*d*: Fourth ledge beam
17: Grid of lower beams
18: Load hanging plane
19: Lower first supporting plane
20: Lower beam upper surface
21: Lower second supporting plane
22: Ledge upper surface
23: Sealed area
24: Sealed section area
25: Wall sections of longitudinal and transverse upper side beams
26: Side beam openings
27*a*: Main deck
27*b*: Lower deck
30: First protruding element
31: Second protruding element
32: First module side
33: Second module side
34: Distance
35: Module bottom
UH: Upper hull
LH: Lower hull

The invention claimed is:

1. A semi-submersible offshore platform comprises a main structure comprising two longitudinal lower side beam structures, two transverse lower side beam structures and four columns, the longitudinal and transverse lower side beam structures are located between the four columns connecting the four columns with each other such that the semi-submersible offshore platform exhibits a frame shaped submersible pontoon having a lower central opening, the four columns extends upwards from the frame shaped submersible pontoon, wherein the main structure of the semi-submersible offshore platform comprises two longitudinal upper side beam structures and two transverse upper side beam structures, the longitudinal and transverse upper side beam structures are located between the four columns connecting the four columns with each other such that the semi-submersible offshore platform exhibits a frame shaped deck box structure having an upper central opening arranged to receive at least one structural module, where the structural module has a substantially rectangular shape, and comprises at least a first and second load carrying protruding element, the first load carrying protruding element is located on a first module side and the second load carrying protruding element is located on a second module side, the at least two load carrying protruding elements are arranged at a distance from a bottom of the structural module such that the structural module can hang in the upper central opening of the semi-submersible offshore platform, being carried by the at least two load carrying protruding elements such that air is allowed to flow through the upper central opening enabling an improved ventilation of the entire semi-submersible offshore platform.

2. The semi-submersible offshore platform according to claim 1, wherein the longitudinal and transverse upper side beam structures and the four columns exhibiting the frame shaped deck box structure are load carrying structural elements arranged to be able to carry at least one structural module.

3. The semi-submersible offshore platform according to claim 1, wherein the frame shaped deck box structure and the upper central opening have a substantially rectangular shape.

4. The semi-submersible offshore platform according to claim 1, wherein the longitudinal and transverse upper side beam structures comprise side beam upper surfaces, the four columns comprise upper portions comprising column upper surfaces which are located between the side beam upper surfaces, wherein the side beam upper surfaces and the column upper surfaces define a horizontal load hanging plane.

5. The semi-submersible offshore platform according to claim 4, wherein the upper central opening comprises a reinforcing deck box beam arranged to connect the longitudinal upper side beam structures or the transverse upper side beam structures, the reinforcing deck box beam is located in the same load hanging plane as the longitudinal and transverse upper side beam structures, the reinforcing deck box beam is a load carrying structural element arranged to be able to carry the at least one structural module.

6. The semi-submersible offshore platform according to claim 5, wherein the upper central opening comprises at least one lower beam arranged to connect the reinforcing deck box beam with the longitudinal upper side beam structures or the transverse upper side beam structures, the at least one lower beam comprises a lower beam upper surface which define a lower first supporting plane which is parallel to the load hanging plane, the at least one lower beam is a load supporting structural element arranged to be able to support the at least one structural module.

7. The semi-submersible offshore platform according to claim 4, wherein the upper central opening comprises a grid of lower beams arranged to connect the longitudinal upper side beam structures and the transverse upper side beam structures, the lower beams of the grid comprises lower beam upper surfaces which define a lower first supporting plane which is parallel to the load hanging plane, the grid of lower beams is a load supporting structure arranged to be able to support the at least one structural module.

8. The semi-submersible offshore platform according to claim 4, wherein the deck box structure comprises at least one ledge beam protruding from the longitudinal and transverse upper side beam structures into the upper central opening, the at least one ledge beam comprises a ledge upper surface which define a lower second supporting plane which is parallel to the load hanging plane, the at least one ledge beam is arranged to act as a supporting console for the at least one structural module.

9. The semi-submersible offshore platform according to claim 1, wherein the longitudinal and transverse upper side beam structures comprise wall sections perforated with a plurality of side beam openings.

10. The semi-submersible offshore platform according to claim 1, wherein the longitudinal and transverse upper side beam structures comprise sealed areas.

11. The semi-submersible offshore platform according to claim 1, wherein the at least two protruding elements are positioned on the frame shaped deck box structure and/or the reinforcing deck box beam such that the structural module hangs in the upper central opening, where the frame shaped deck box structure and/or the reinforcing deck box beam and the at least two protruding elements are the load carrying structure for the at least one structural module hanging in the upper central opening.

12. The semi-submersible offshore platform according to claim 1, wherein the at least one structural module is arranged to be supported by the at least one lower beam and/or the at least one ledge beam.

13. The semi-submersible offshore platform according to claim 1, wherein several structural modules hangs in the upper central opening of the semi-submersible offshore platform.

* * * * *